US011509995B1

(12) United States Patent
Paranirupasingam

(10) Patent No.: US 11,509,995 B1
(45) Date of Patent: Nov. 22, 2022

(54) ARTIFICIAL INTELLIGENCE BASED SYSTEM AND METHOD FOR GENERATING SILENCE IN EARBUDS

(71) Applicant: Abhivarman Paranirupasingam, Toronto (CA)

(72) Inventor: Abhivarman Paranirupasingam, Toronto (CA)

(73) Assignee: Abhivarman Paranirupasingam, Toronto (CA)

( * ) Notice: Subject to any disclaimer, the term of this patent is extended or adjusted under 35 U.S.C. 154(b) by 0 days.

(21) Appl. No.: 17/346,217

(22) Filed: Jun. 12, 2021

(51) Int. Cl.
*G10K 11/178* (2006.01)
*H04R 1/10* (2006.01)

(52) U.S. Cl.
CPC ..... *H04R 1/1083* (2013.01); *G10K 11/178* (2013.01); *H04R 1/1016* (2013.01); *H04R 2460/01* (2013.01)

(58) Field of Classification Search
CPC ..... H04R 1/1083; H04R 1/1016; H04R 2460/01; G10K 11/178
USPC ..... 381/71.6
See application file for complete search history.

(56) References Cited

U.S. PATENT DOCUMENTS

2021/0289296 A1* 9/2021 Stamenovic ..... H04R 3/005

* cited by examiner

*Primary Examiner* — Vivian C Chin
*Assistant Examiner* — Friedrich Fahnert

(57) ABSTRACT

An earbud system for reducing noise is disclosed. The earbud system comprises an analog to digital converter to convert analog audio signals of a sound captured by one or more sound sensors into digital audio signals, and one or more processors to filter one or more raw bits with a specific frequency band from the digital audio signals to obtain filtered digital audio signals and extract human audible frequency bands from the filtered digital audio signals. The processors predict and/or classify, using an artificial intelligence based mechanism, the extracted human audible frequency bands into ambient noise corresponding to a first set of frequencies and desired sound, to be heard by the user, corresponding to a second set of frequencies. The processors further generate anti-phase signals for a first set of frequencies to reduce noise, and audible phase signals for the second set of frequencies.

9 Claims, 6 Drawing Sheets

ARTIFICIAL INTELLIGENCE BASED SYSTEM AND METHOD FOR GENERATING SILENCE IN EARBUDS

TECHNICAL FIELD

The present disclosure relates to wireless earphones. In particular, the present disclosure relates to an artificial intelligence based system and method for generating anti-phase signals of an audible sound in earphones, such as but not limited to true wireless sound earbuds, for reducing noise and/or generating silence.

BACKGROUND

Background description includes information that may be useful in understanding the present invention. It is not an admission that any of the information provided herein is prior art or relevant to the presently claimed invention, or that any publication specifically or implicitly referenced is prior art.

Nowadays, due to evolution of human lifestyle and daily challenges, an insufficient sleep may cause people vulnerable to many issues such as attention lapses, reduced cognition, delayed reaction, and the like. Efforts have been made in past to develop products to improve sleep, for example, silence generators which is used to block sound wave that penetrate through ears canal, and primitive solutions including anti-wave generators based on linear mode. The silence generator includes selected materials with high attenuation value to block audio waves from propagating inside the ear canal. The anti-wave generators include electronic devices where negative waves for any sound picked by electronic microphones will be generated to make sure audio wave amplitudes, when reach the ear canal, is zero or close to zero.

Further, to address the above issues, those skilled in the art have proposed many solutions such as a wrapper device which is placed around a user's head covering eyes and ears of the user. The wrapper device is based on materials that block sound penetration. This wrapper device is not comfortable, preferably during sleeping. When it comes to sleep, earbuds which are comfortable and well suited for the use as the earbuds are miniature speakers that fit into user's ears at the entry of ear canals. These earbuds are provided with active noise cancellation digital signal processor (DSP) Core. However, these earbuds are failed to generate effective sound isolation inside the ear canals. Besides, other solutions of the above mentioned issues are also proposed, which are based on arithmetic operations to generate silence, where these mathematical operations only start to generate anti-wave when all frames of the audio are received which could lead to delay, causing some audio waves leak inside the ear canal. Since the speed of sound in air is 761 mph and some arithmetic operations are based on complex algorithm to generate the sound anti-waves which may take little bit more time than unwanted sound to reach ear canal. Despite that some audio wave has different level of power, some existing anti-wave generating products generate anti-wave and/or negative wave to the ear canal due to far field and close field of sound waves.

Patent document U.S. Pat. No. 9,972,299B2 discloses a mechanism for active noise cancellation/control for headphones based on a combination of aural and nonaural noise signals by calculating a noise reduction signal based on a function combining the nonaural noise signal and the aural noise signal and calculating a noise reduced signal based on a combination of a content signal prepared to be played by an electro acoustic transducer and the noise reduction signal. Further, the circuit is instructed to play the noise reduced signal via the at least one electro acoustic transducer.

Patent document U.S. Pat. No. 9,972,299B2 discloses a noise suppression circuitry for use in an audio signal processing circuit. The circuitry incorporates multiple noise suppression techniques including a detector for detecting multiple types of noise and multiple corresponding techniques for removing the detected noise. A plurality of noise activity detectors is each adapted for detecting the presence of a different type of noise in a received signal. Noise suppression circuit further includes a plurality of different types of noise reduction circuits, which are each adapted for removing a different type of detected noise. Each noise reduction circuit respectively corresponds a noise activity detector.

In view of the above, there is, therefore, a need to provide an easy to use, efficient, cost-effective and reliable artificial intelligence based system and method for generating anti-phase of an audible sound or anti-waves in earphones, such as but not limited to true wireless sound earbuds, to cancel unwanted sound waves to prevent unwanted sound from reaching ear canals, which may help to enhance sleep quality.

Objects of the Present Disclosure

A general object of the present disclosure is to provide an efficient and cost-effective solution of the above-mentioned problems.

An object of the present disclosure is to provide a robust system and method for generating accurate anti-wave and/or anti-phase signals in earphones, such as but not limited to, earbuds for generating silence.

Another object of the present disclosure is to provide a reliable artificial intelligence based earbud system for generating audible sound anti-phase signals or anti-waves, in accordance with user instructions received in real-time, to cancel unwanted sound waves, thereby preventing unwanted sound from reaching ear canals, which may help to enhance sleep quality of the user.

Another object of the present disclosure is to provide a system and method that are capable to generate anti-phase of an audible sound and/or anti-waves for noise waves in earbuds using an artificial intelligence based mechanism based in real time firmware application and/or dedicated ASIC IP, which predicts the noise waves in a sound to create silence sounds.

Another object of the present disclosure is to provide a cost-effective system and methods for generating anti-phase of an audible sound in earbuds to make sure audio wave amplitudes, when reach ear canals, are zero or close to zero.

Yet another object of the present disclosure is to provide a simple artificial intelligence based system for generating silence in earbuds, which can be embedded on a system on a chip (SoC) and/or a field-programmable gate array (FPGA) and/or any digital signal processor.

Still another object of the present disclosure is to provide an artificial intelligence based earbud system that can be easily fitted in human ears and generate anti-phase of audio/sound waves to block any unwanted sound to travel through human ears canals.

SUMMARY

Aspects of the present disclosure relate to wireless earphones. In particular, the present disclosure relates to an artificial intelligence based system and method for generating anti-phase signals for an audible unwanted sound-in earphones, such as but not limited to true wireless sound earbuds, to prevent the unwanted sound from reaching user's ear canals, thereby generating silence. Thus, the proposed system and method may help to improve sleep quality of users by generating silence in ear canals of the users and consequently health issues caused due to insufficient sleep can be avoided.

In an aspect, the present disclosure provides an earbud system for reducing noise. The proposed earbud system can include an analog to digital converter for converting analog audio signals of a sound captured by one or more sound sensors of the earbud system into digital audio signals, one or more processors (hereinafter, for simplicity also referred to as processors) and a memory coupled to the processors, the memory comprising instruction which when executed by the processors. The processors can be configured to filter one or more raw bits with a specific frequency band from the digital audio signals to obtain filtered digital audio signals, extract human audible frequency bands from the filtered digital audio signals, and generate anti-phase signals, using an artificial intelligence based mechanism deployed or to be used in real time firmware application and/or dedicated ASIC IP, for a first set of frequencies of the extracted human audible frequency bands to reduce noise. A sum of absolute value of the anti-phase signals and the first set of frequencies of the extracted human audible frequency bands can be zero or close to zero.

In an embodiment, artificial intelligence (AI) based mechanism can be a set of computer programs and instructions used for instilling intelligence in machines and thus making them learn from experience and adjust to new inputs and perform human-like tasks. One of characteristics of the AI is its ability to rationalize and take actions that have a best chance of achieving a specific goal. The computer programs and instructions are adapted to learn from and adapt to new data without being assisted by humans.

In an embodiment, the filtration of the one or more raw bits with the specific frequency band from the audio frequency bands can be based on any or combination of a set of first predefined instructions and an instruction received, in real-time, from a user associated with the earbud system. The set of first predefined instructions can be a set of predefined algorithms or a set of predefined mechanisms.

In an embodiment, the processors can generate audible phase signals, using the artificial intelligence based mechanism, for a second set of frequencies. The second set of frequencies pertain to frequencies other than the first set of frequencies of the extracted human audible frequency bands. The generated audible phase signals are analog signals.

In an embodiment, based on the instruction received, in real-time, from the user, the processors can predict, using the artificial intelligence based mechanism, based on for example real time firmware application and/or dedicated ASIC IP, the first set of frequencies of the extracted human audible frequency bands for which anti-phase signals to be generated and the second set of frequencies of the extracted human audible frequency bands for which the audible phase signals to be generated. The processors can classify the extracted human audible frequency bands into ambient noise corresponding to the first set of frequencies and desired sound to be heard by the user corresponding to the second set of frequencies.

In an embodiment, the processors can extract audio features from the extracted human audible frequency bands. Extraction of the audio features can be based on any or combination of a set of second predefined instructions and the instruction received, in real-time, from the user associated with the earbud system. The extracted audio features can include time frame, amplitude, frequency, and human emissions associated with the extracted human audible frequency bands, noise type etc. The set of second predefined instructions can be predefined algorithms.

In an embodiment, the extracted human audible frequency bands can range for audible frequency bands suitable for different age groups.

In an embodiment, the processors can include a system on chip.

Another aspect of the present discloser provides a method for reducing noise in an earbud system. The proposed method can include steps of converting, though an analog to digital converter, analog audio signals of a sound captured by one or more sound sensors of the earbud system into digital audio signals, and filtering, through one or more processors, one or more raw bits with a specific frequency band from the digital audio signals to obtain filtered digital audio signals. Further, the method can include steps of extracting, through the one or more processors, human audible frequency bands from the filtered digital audio signals, and generating, through the one or more processors, anti-phase signals , using an artificial intelligence based mechanism, for a first set of frequencies of the extracted human audible frequency bands to reduce noise. In an embodiment, a sum of absolute value of the anti-phase signals and the first set of frequencies of the extracted human audible frequency bands is zero or close to zero.

The proposed method can include a step of generating, through the one or more processors, audible phase signals, using the artificial intelligence based mechanism, for a second set of frequencies. The second set of frequencies pertain to frequencies other than the first set of frequencies of the extracted human audible frequency bands. The generated audible phase signals can be analog signals and/or digital signals depending on a sound/audio driver.

In an embodiment, the filtration of the one or more raw bits with a specific frequency band from the audio frequency bands can be based on any or combination of the set of first predefined instructions and an instruction received, in real-time, from a user associated with the earbud system.

In an embodiment, based on the instruction received, in real-time, from the user, the processors can predict, using the artificial intelligence based mechanism, the first set of frequencies of the extracted human audible frequency bands for which audible sound anti phase signals to be generated and the second set of frequencies of the extracted human audible frequency bands for which the audible phase signals to be generated. the processors can classify the extracted human audible frequency band into ambient noise corresponding to the first set of frequencies and desired sound to be heard by the user corresponding to the second set of frequencies.

The method can include a step of extracting, through the processors, audio features from the extracted human audible frequency bands. Extraction of the audio features can be based on any or combination of a set of second predefined instructions and the instruction received, in real-time, from the user associated with the earbud system. The extracted audio features can include time frame, amplitude, frequency, and human emissions associated with the extracted human audible frequency bands.

Various objects, features, aspects, and advantages of the inventive subject matter will become more apparent from the following detailed description of preferred embodiments, along with the accompanying drawing figures in which like numerals represent like components.

BRIEF DESCRIPTION OF DRAWINGS

The accompanying drawings are included to provide a further understanding of the present disclosure and are incorporated in and constitute a part of this specification. The drawings illustrate exemplary embodiments of the present disclosure and, together with the description, serve to explain the principles of the present disclosure. The diagrams are for illustration only, which thus is not a limitation of the present disclosure.

In the figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1:
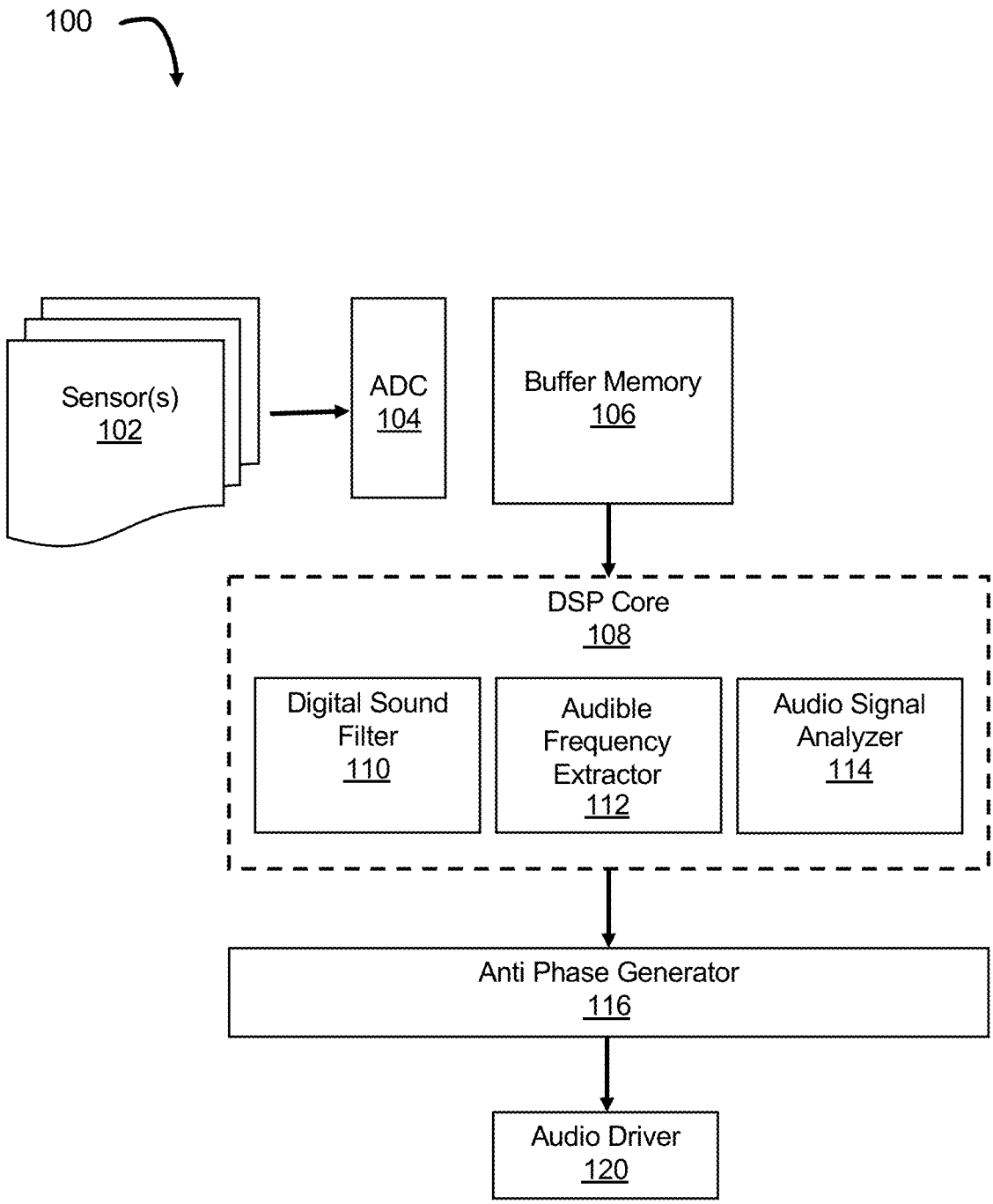
FIG. 1 illustrates a schematic diagram of the proposed earbud system for generating silence, in accordance with embodiments of the present disclosure.

In the following description, numerous specific details are set forth in order to provide a thorough understanding of embodiments of the present invention. It will be apparent to one skilled in the art that embodiments of the present invention may be practiced without some of these specific details.

Embodiments of the present invention include various steps, which will be described below. The steps may be performed by hardware components or may be embodied in machine-executable instructions, which may be used to cause a general-purpose or special-purpose processor programmed with the instructions to perform the steps. Alternatively, steps may be performed by a combination of hardware, software, firmware and/or by human interface control.

Embodiments of the present invention may be provided as a run time application product, which may include a machine-readable storage medium tangibly embodying thereon instructions, which may be used to program a computer (or other electronic devices) to perform a process. The machine-readable medium may include, but is not limited to, fixed (hard) drives, magnetic tape, floppy diskettes, optical disks, compact disc read-only memories (CD-ROMs), and magneto-optical disks, semiconductor memories, such as ROMs, PROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e.g., computer programming code, such as software or firmware).

Various methods described herein may be practiced by combining one or more machine-readable storage media containing the code according to the present invention with appropriate standard computer hardware to execute the code contained therein. An apparatus for practicing various embodiments of the present invention may involve one or more computers (or one or more processors within a single computer) and storage systems containing or having network access to computer program(s) coded in accordance with various methods described herein, and the method steps of the invention could be accomplished by modules, routines, subroutines, or sub parts of a computer program product.

The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Exemplary embodiments will now be described more fully hereinafter with reference to the accompanying drawings, in which exemplary embodiments are shown. This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

While embodiments of the present invention have been illustrated and described, it will be clear that the invention is not limited to these embodiments only. Numerous modifications, changes, variations, substitutions, and equivalents will be apparent to those skilled in the art, without departing from the spirit and scope of the invention, as described in the claim.

Embodiment explained herein relate to wireless earphones. In particular, the present disclosure relates to an artificial intelligence based system and method for generating—anti-phase audible sound signals in earphones, such as but not limited to true wireless sound earbuds, to prevent unwanted sound from reaching user's ear canals, thereby generating silence. Thus, the proposed system and method may help to improve sleep quality of users by generating silence in ear canals of the users and consequently health issues caused due to insufficient sleep can be avoided.

FIG. 1 illustrates a schematic diagram 100 of the proposed earbud system for generating silence, in accordance with embodiments of the present disclosure. In an embodiment, the earbud system can include one or more sound sensors (hereinafter, also referred to as sensors) 102 to capture a sound. The sound can be sound signals of single sound generating body or mixture of sound signals of multiple sound generating bodies, such as but not limited to, human, machine, vehicle, animal and any other objects. Output data from the sound sensors 102 can be analog audio signals which can include single ended analog signals and/or differential ended analog signals. An Analog to Digital convert (ADC) 104 of the earbud system can be operatively coupled to the sensors 102 to receive the output data from the sound sensor 102. The ADC 104 can be configured to convert the data received from the sensors 102, i.e., the analog audio signals of the captured sound, into digital audio signals. The converted digital audio signals can be presented as RAW bits, These RAW bits can be stored, temporarily, in a buffer memory 106. In an embodiment, the buffer memory 106 can be a volatile memory, such as random-access memory (RAM), Hyper Static random-access memory (Hyper SRAM), dynamic random-access memory (DRAM) and the like. The buffer memory 106 can be configured to temporarily hold the incoming data from the sensors 102 until a conversion cycle of the ADC 104 is terminated.

In an embodiment, when the stored converted digital signals reached a threshold level in the buffer memory 106, the buffer memory 106 can be configured to send an interrupt signal and/or request signal to a processing engine such as a digital signal processor (DSP) core 108, wherein the interrupt signal and/or request signal can pertain to a sampled and/or converted data is ready for the DSP core 108 for further processing. In an embodiment, the DSP core 108 can be a specialized microprocessor chip, with its architecture optimized for the operational needs of digital signal processing. In another embodiment, the DSP core 108 can be presented as application-specific integrated circuit (ASIC) core and/or firmware code, or FPGA based core or a hybrid which combined accelerated hardware IP and firmware code.

In an embodiment, the DSP core 108 can include a set of modules including a digital sound filter 110, an audible sound extractor 112 and an audio signal analyzer 114.

In an embodiment, the digital sound filter 110 can be configured to filter one or more raw bits with a specific frequency band or undesired frequency bands from the digital audio signals to obtain filtered digital audio signals. The filtration of the raw bits with the specific frequency band or undesired frequency bands from the audio frequency bands can be based on any or combination of a set of first predefined instructions and an instruction received, in real-time, from a user associated with the earbud system. In an embodiment, the first predefined instructions can be stored in a memory that can be operatively coupled to the DSP core 108. In an embodiment, the specific frequency band or undesired frequency band can correspond to frequency bands beyond human audible range. In another embodiment, the use, through the instructions, can define the specific frequency band or undesired frequency bands which are required to be removed from the digital audio signals to obtain the filtered digital audio signals. For instance, if the digital audio signals include audio frequency bands associated with audio signals of human, alarm clock, vehicles, horn noise, dog bark, drilling noise, gunshot noise, jackhammer noise, siren noise, street music, squeak, and rattling noise, user can define a few frequency bands as the undesired frequency bands which are associated with horn noise, dog bark, drilling noise, gunshot noise, jackhammer noise, siren noise, street music, squeak, and rattling noise to remove these undesired frequency bands.

In an embodiment, the audible sound extractor 112 can receive the filtered digital audio signals from the digital sound filter 110. The audible sound extractor 112 can be configured to extract human audible frequency bands from the filtered digital audio signals. The extracted human audible frequency bands can range for audible frequency bands suitable for different age groups including child (0-12 years), adolescence (13-18 years), adult (19-59 years) and senior Adult (60 years and above). For instance, the extracted human audible frequency bands can range from about 20 Hz to 20 kHz.

In an embodiment, the audio signal analyzer 114 can receive the extracted human audible frequency bands from the audible sound extractor 112. The audio signal analyzer 114 can be configured to extract audio features from the extracted human audible frequency bands. Extraction of the audio features can be based on any or combination of a set of second predefined instructions and the instruction received, in real-time, from the user associated with the earbud system. The second predefined instructions can be stored in the memory operatively coupled to the DSP core 108. The extracted audio features can include time frame, amplitude, frequency, and human emissions associated with the extracted human audible frequency bands. In an embodiment, the user can define the extracted audio features based in its requirements.

In an embodiment, the DSP core 108 can send an interrupt signal to an anti-phase generator 116 which can be linked to the DSP core 108 through a digital communication bus, wherein the digital communication bus can be a Serializer/Deserializer (SerDes), parallel, any protocol communication defined by the user or any other suitable digital communication bus. The SerDes is a pair of functional blocks commonly used in high-speed communications to compensate for limited input/output. These blocks convert data between serial data and parallel interfaces in each direction.

In an embodiment, the anti-phase generator 116 can be based on an artificial intelligence (Ai) based mechanism, based on for example real time firmware application and/or dedicated ASIC IP. The anti-phase generator 116 can receive the extracted audio features from the audio signal analyzer 114. The artificial intelligence based anti-phase generator 116 can handle the input features and/or attributes based on trained pre-dataset and/or over time capture data and/or self-trained data.

In an embodiment, the anti-phase generator 116 can predict, using the artificial intelligence based mechanism, a first set of frequencies of the extracted human audible frequency bands for which anti-phase signals to be generated and a second set of frequencies of the extracted human audible frequency bands for which the audible phase signals to be generated. In another embodiment, anti-phase generator 116 can perform prediction based on the instruction received, in real-time, from the user, the one or more processors predict.

In an embodiment, the prediction by the anti-phase generator 116 can be based on complex arithmetic operations, which can be performed using a floating-point unit (FPU). In another embodiment, the anti-phase generator 116 can classify the extracted human audible frequency bands into ambient noise corresponding to the first set of frequencies and desired sound to be heard by the user corresponding to the second set of frequencies. The second set of frequencies pertain to frequencies other than the first set of frequencies of the extracted human audible frequency bands. For instance, when the extracted human audible frequency bands are sound signals of vehicle engine noise, horn noise, alarm sound, and specific human voice, the anti-phase generator 116 can classify the extracted human audible frequency bands between the ambient noise, which can be associated annoying sound such as vehicle engine noise and horn noise and desired sound such as alarm sound, specific human voice, such as voice of a family member etc. which is required to be heard by the user. In an embodiment, the user can define, by providing instructions/command signals, what type of sound he/she wants to listen without any anti-phase, i.e. transparent mode and/or pass-thru mode, and what type of sound he/she wants to block by generating anti-phase signals.

In an embodiment, after prediction by the anti-phase generator 116, an audio driver 118 can generate anti-phase signals or anti waves for the first set of frequencies of the extracted human audible frequency bands to reduce noise, i.e. the audio driver 118 can emit sound waves with the same amplitude but with inverted phase to the first set of frequencies, therefore the generated anti-phase signals—signals and the first set of frequencies of the extracted human audible frequency bands cancel each other out.

In an embodiment, a sum of absolute value of the anti-phase signals and the first set of frequencies of the extracted human audible frequency bands is zero or close to zero, therefore noise can be reduced in the ear, therefore a very low amplitude may reach the human ear canal and any leaked sound may not have any distraction for the human ear.

Further, the audio driver 118 can generate audible phase signals for the second set of frequencies. The generated audible phase signals can be analog signals which can include single ended analog signals and/or differential ended analog signals.

In an embodiment, the extracted audio features including time frame, amplitude, frequency, and human emissions can be used as basic features for prediction by artificial intelligence based anti-phase generator 116. The extracted audio features can be for classification of the extracted human audible frequency bands. Further, the extracted audio features and the extracted human audible frequency bands can be used as input for training file and/or self-trained data.

Figure 2:
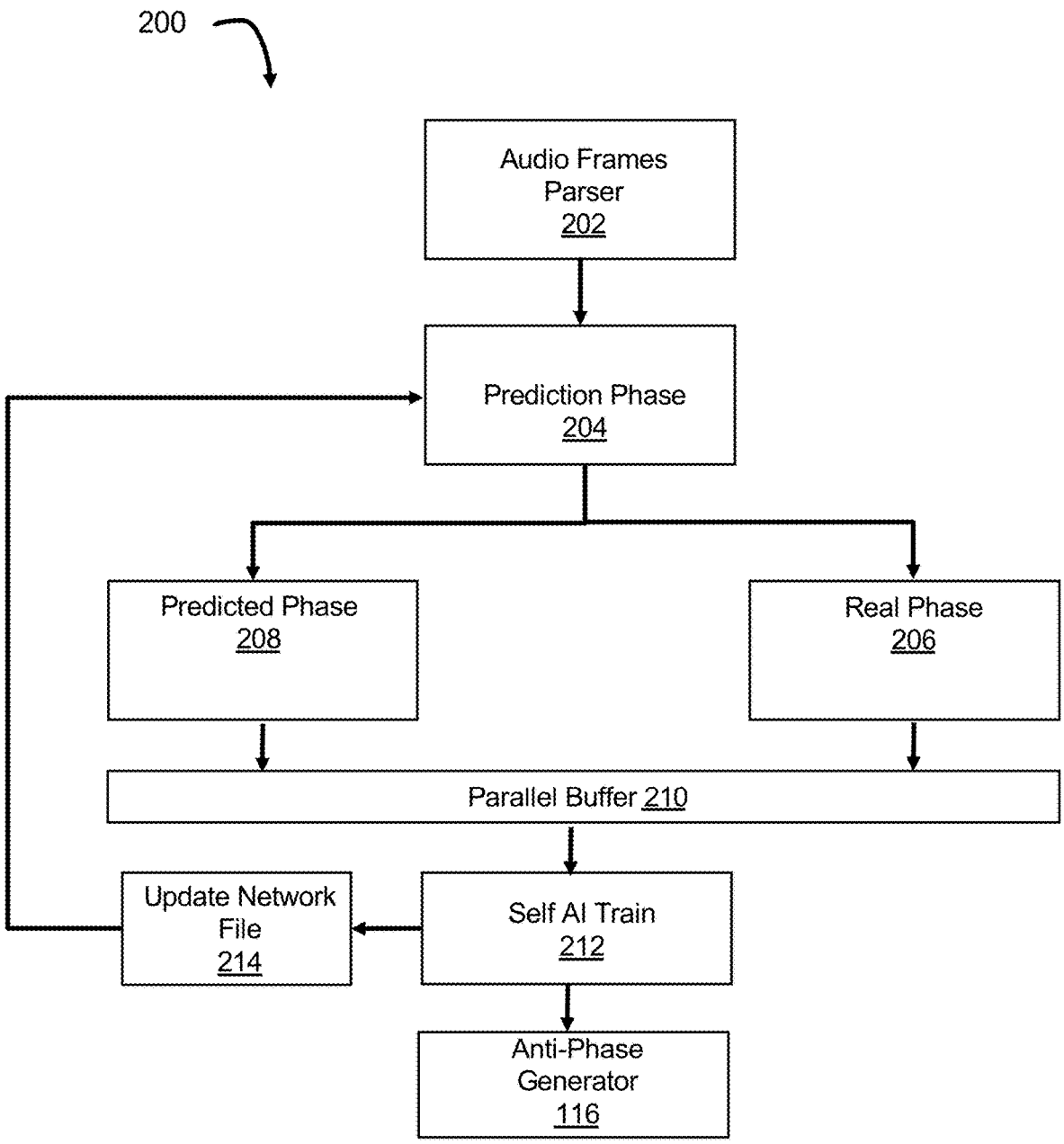
FIG. 2 illustrates a flow diagram of a working of an artificial intelligence based anti-phase generator of the proposed earbud system, in accordance with an embodiment of the present disclosure.

FIG. 2 illustrates a flow diagram 200 of a working of an artificial intelligence based anti-phase generator, in accordance with an embodiment of the present disclosure. In an embodiment, after extraction of human audible frequency bands and audio features, the extracted human audible frequency bands or audio frames/sampled data can be parsed trough an audio frame parser 202, then a prediction phase 204 can generate two data set one is a real phase 206 which is exactly reverse of sampled phase at 202, and second one is predicted phase 208. Both the predicted phase 208 and the real phase 206 can be pushed to a parallel buffer/buffer 210 at the same time, and then to a self Ai train 212. The self Ai train 212 may compare a mean square error between the predicted phase 208 and the real phase 206, and when the mean square error between both value of each phase greater than a threshold defined by the user, the Self Ai Train 212 can update a Ai network files/setting 214, whereas the cycle keep going until the mean square error is less than the threshold defined by the user, then the anti-phase generator 116 push the result to the next module/audio driver.

Figure 3:
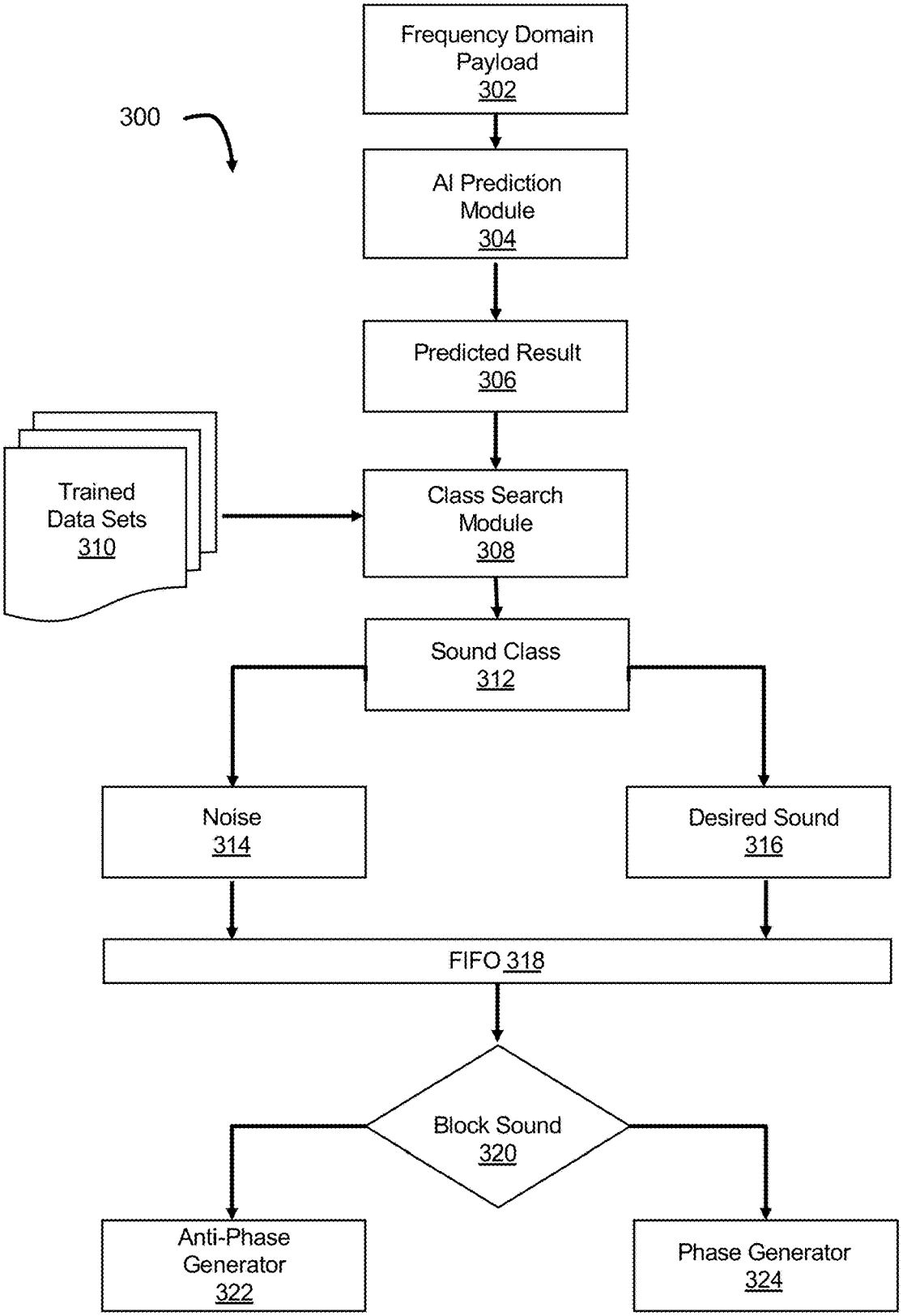
FIG. 3 illustrates a flow diagram of a working of an artificial intelligence based mechanism of the proposed earbud system, in accordance with an embodiment of the present disclosure.

FIG. 3 illustrates a flow diagram 300 of a working of an artificial intelligence based mechanism of the proposed earbud system, in accordance with an embodiment of the present disclosure. In an embodiment, an artificial intelligence (Ai) core can handle a transparent mode and/or a surround mode, where such desired/important sound like wake up alarm and/or kids crying voice and/or any important voice selected by the user are allowed to pass through the user ear. A frequency domain payload 302 can perform conversion from time domain to frequency domain, for example using FFT algorithm, and forward each audio frame to an Ai prediction module 304, where the Ai prediction module 304 may predict results without waiting until the all audio frame to be handled, the predicted result 306 of the Ai prediction module 304 may be pushed to a class search module 308 and the final result may depend on pre-dataset and/or trained data 310 and/or user instructions/settings. A sound class 312 can be configured to push the data if the coming audio is noise 314 or desired/important/priority sound 316 require to be heard by the user. The incoming data can be hold inside a First-In, First-Out (FIFO) register 318. A sound block 320, based on the type of data passing, select if the sound is classified as noise, then it will be pushed to an anti-phase generator 322 to cancel the noise, else if the sound is classified as desired/important sound and/or defined by user to passthrough then the data will be pushed to a phase generator 324 so that the desired sound may passthrough the user ear.

Figure 4:
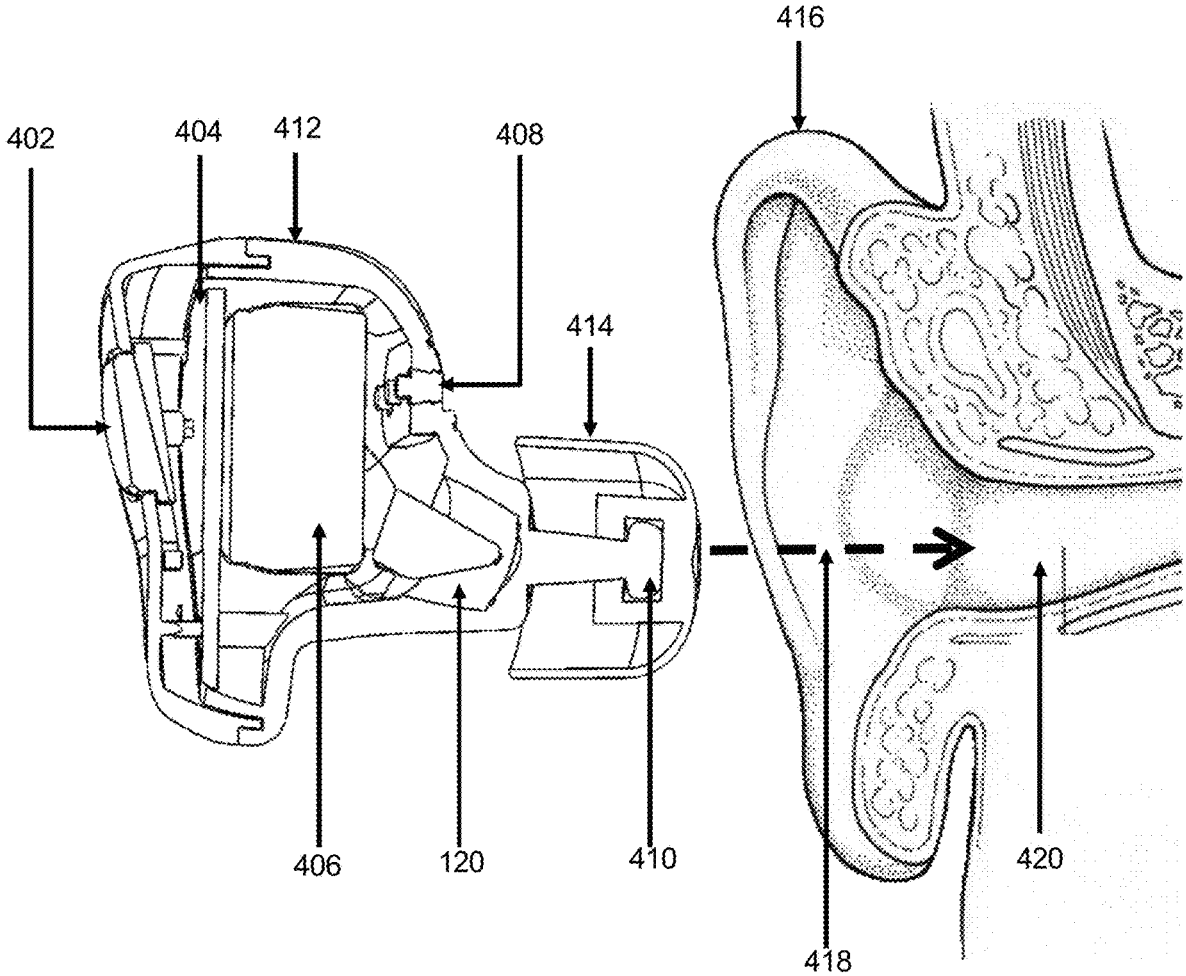
FIG. 4 illustrates a sectional view of the proposed earbud system and its implementation, in accordance with an embodiment of the present disclosure.

FIG. 4 illustrates a sectional view of the proposed earbud system and its implementation, in accordance with an embodiment of the present disclosure. In an embodiment, the earbud system can include a user control 402 through which the user can select between different options, such as but not limited to system ON/OFF, type of sound he/she wants to hear and type of sound he/she wants to block etc. based on requirement, and an electronic printed circuit board 404. The electronic printed circuit board 404 can be composed from a microcontroller unit (MCU) and/or a System on Chip (SoC) that is programmed to perform functions of the earbud system. The MCU can be a small computer on a single Die-Bare ASIC. The MCU can include one or more central processing units (processor cores) along with memory and programmable input/output peripherals. The SoC can be an integrated circuit that integrates all or most components of a computer or other electronic system. These components can include a central processing unit (CPU), memory, input/output ports and secondary storage, a parallel acceleration cores and the like on a single ASIC IP core or microchip. It may include digital, analog, mixed-signal, and often radio frequency signal processing functions.

The earbud system can further include a power source 406 and a charger source 408, which are vital to the earbud system. The power source 406 can be any of a rechargeable battery and/or a super capacitor and/or a static source of power. The power source 406 can be of any dimension based on requirement. The charger source 408 can be a wireless source and/or DC source and/or an energy harvester. All audible sound phases and/or antiphase can be generated in analog format through the audio driver 120, propagation waves can come out from a plastic canal 410.

In an exemplary embodiment, all components of the earbud system accommodated in single enclosure 412.The enclosure 412 may be equipped by a soft ear tip 414 depends on user requirements. When the user inserts the ear tip 414 into his/her ear 416 and the earbud system is turned ON, only generated phase signals 418 propagate through the ear canal 420.

Figure 5:
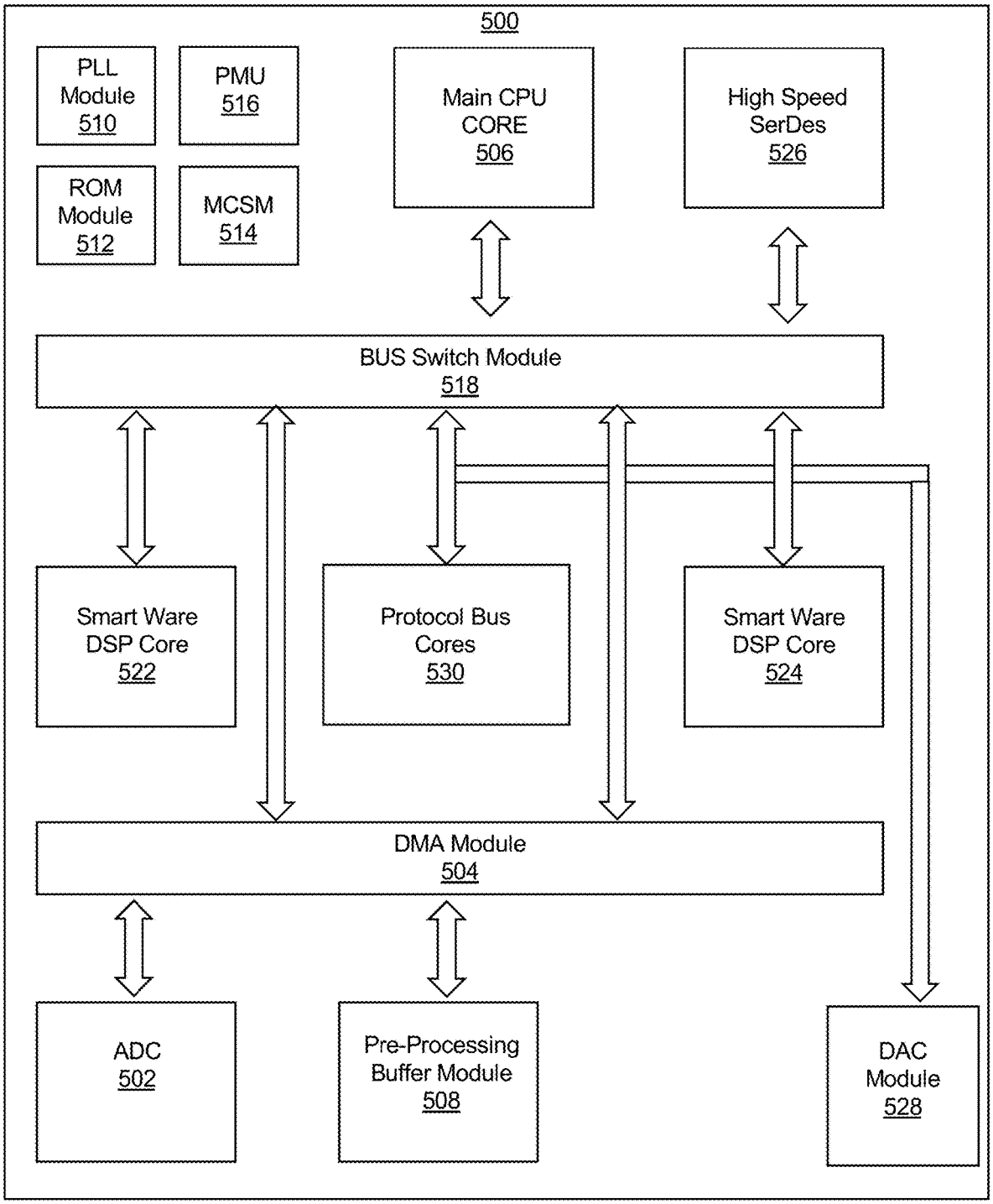
FIG. 5 illustrates a block diagram of a hardware architecture to implement the proposed earbud system, in accordance with an embodiment of the present disclosure.

FIG. 5 illustrates a block diagram of a hardware architecture to implement the proposed earbud system, in accordance with an embodiment of the present disclosure. As shown, the block diagram which represents hardware IP modules 500 of the earbud system components may be provided to a chipset maker and/or ASIC maker and/or structure ASIC maker for production/implementation of the earbud system. The persons skilled in the art will appreciate that configuration of the hardware IP modules /solution core 500 are not fixed and may be different or may vary to perform intended functions of the present disclosure, and all such variations are covered in the scope of the present disclosure without any limitations whatsoever. In embodiment, an ADC module 502 configured for converting analog signals into digital signals is operatively coupled and/or interface with one or more sensors of the earbud system that capture sound. Converted digital data from the ADC 502 may pass through a data mass access (DMA) module 504 to a pre-processing buffer module 508 without overloading a main CPU core 506. The main CPU Core 506 can be any architecture such as Advanced RISC Machines ,PowerPC and more depends on user requirements and application domain requirements. Further, a phase lock loop (PLL) module 510 can be based on a ROM module 512 as this module is the early boot up, which depends on a main clock source module (MCSM) 514 and a power module unit (PMU) 516. The PMU module 516 can maintain stable DC power for all modules in the earbud system. A bus switch module 518 has important role, that link between the DMA module 504 and other hardware modules. The bus switch module 518 can be any type of switch such as but not limited to Advanced eXtensible Interface-4 (AXI-4). Each module has a slave address and only the main CPU Core 506 has master address and manage communication between all other modules. The DMA module 504 may work independent from the main CPU core 506. When any captured data from the sensors is ready, the captured data may be pushed and/or called by a smart ware DSP core module 522, then the data may be fetched to a Smart ware Ai Core 524 through the main CPU core 506. A high speed SerDes module 526 can be used to interface external memory such as HyperFlash and/or DDR based on the user requirements to accelerate the process of prediction and/or detection. When the anti-phase data is ready, the data may be pushed to a digital to analog converter (DAC) module 528.

Figure 6:
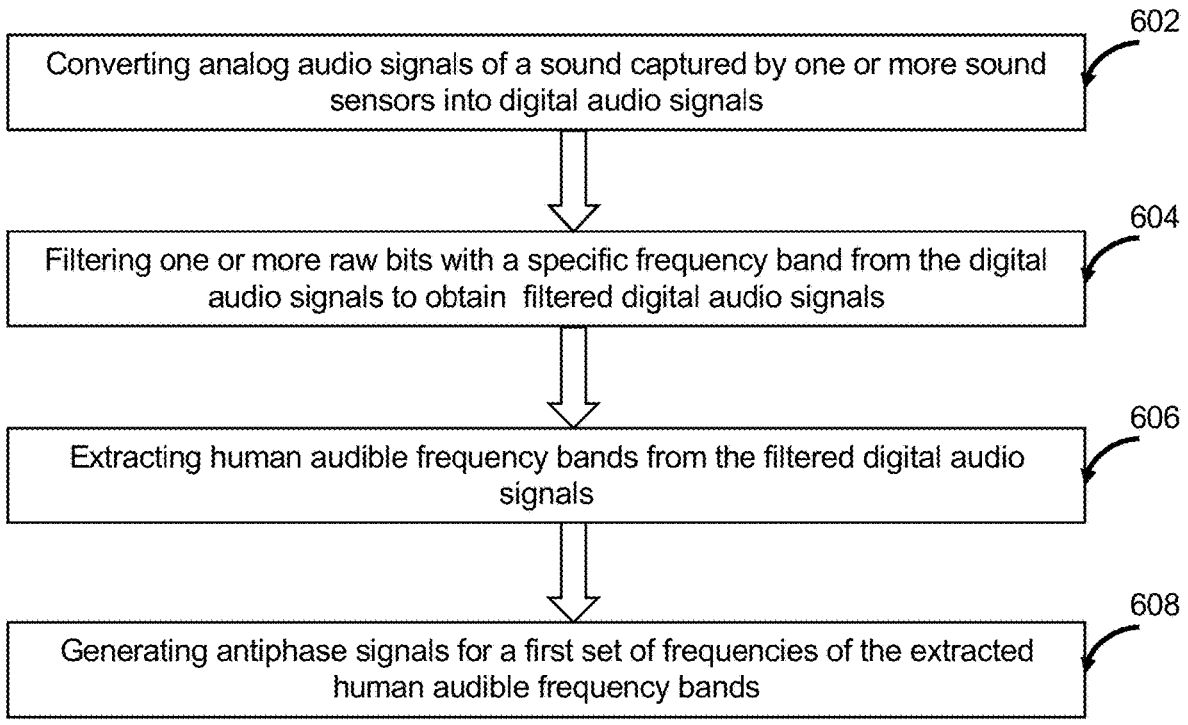
FIG. 6 illustrates a flow diagram of the proposed method for reducing noise in an earbud system, in accordance with an embodiment of the present disclosure.

FIG. 6 illustrates a flow diagram of the proposed method for reducing noise in an earbud system, in accordance with an embodiment of the present disclosure.

In an aspect, the proposed method may be described in the general context of computer-executable instructions. Generally, computer-executable instructions include routines, programs, objects, components, data structures, procedures, modules, functions, etc. that perform particular functions or implement particular abstract data types. The method can also be practiced in a distributed computing environment where functions are performed by remote processing devices that are linked through a communications network. In a distributed computing environment, computer-executable instructions may be located in both local and remote computer storage media, including memory storage devices.

The order in which the method as described is not intended to be construed as limitation and any number of the described method blocks may be combined in any order to implement the method or alternate methods. Additionally, individual blocks may be deleted from the method without departing from the spirit and scope of the subject matter described herein. Furthermore, the method may be implemented in any suitable hardware, software, firmware, or combination thereof. However, for ease of explanation, in the embodiments described below, the method may be considered to be implemented in the above-described earbud system.

In an embodiment, the method 600 can include at a step 602 converting analog audio signals of a sound captured by one or more sound sensors of the earbud system into digital audio signals though an analog to digital converter, and at a step 604 filtering one or more raw bits with a specific frequency band from the digital audio signals to obtain filtered digital audio signals through one or more processors. Further, the method 600 can include at a step 606 extracting human audible frequency bands from the filtered digital audio signals through the one or more processors, and at a step 608 generating, through the one or more processors, anti-phase signals, using an artificial intelligence based mechanism, for a first set of frequencies of the extracted human audible frequency bands to reduce noise. In an embodiment, a sum of absolute value of the anti-phase signals and the first set of frequencies of the extracted human audible frequency bands is zero or close to zero.

In an embodiment, the extracted human audible frequency bands range for audible frequency bands suitable for different age groups.

The proposed method 600 can include a step of generating, through the one or more processors, audible phase signals, using the artificial intelligence based mechanism, for a second set of frequencies. The second set of frequencies pertain to frequencies other than the first set of frequencies of the extracted human audible frequency bands. The generated audible phase signals can be analog signals.

In an embodiment, the filtration of the one or more raw bits with a specific frequency band from the audio frequency bands can be based on any or combination of the set of first predefined instructions and an instruction received, in real-time, from a user associated with the earbud system.

In an embodiment, based on the instruction received, in real-time, from the user, the processors can predict, using the artificial intelligence based mechanism, the first set of frequencies of the extracted human audible frequency bands for which anti-phase signals to be generated and the second set of frequencies of the extracted human audible frequency bands for which the audible phase signals to be generated. the processors can classify the extracted human audible frequency band into ambient noise corresponding to the first set of frequencies and desired sound to be heard by the user corresponding to the second set of frequencies.

The method 600 can include a step of extracting, through the processors, audio features from the extracted human audible frequency bands. Extraction of the audio features can be based on any or combination of a set of second predefined instructions and the instruction received, in real-time, from the user associated with the earbud system. The extracted audio features can include time frame, amplitude, frequency, human emissions associated with the extracted human audible frequency bands , noise type etc.

Thus, it will be appreciated by those of ordinary skill in the art that the diagrams, schematics, illustrations, and the like represent conceptual views or processes illustrating systems and methods embodying this invention. The functions of the various elements shown in the figures may be provided through the use of dedicated hardware as well as hardware capable of executing associated software. Similarly, any switches shown in the figures are conceptual only. Their function may be carried out through the operation of program logic, through dedicated logic, through the interaction of program control and dedicated logic, or even manually, the particular technique being selectable by the entity implementing this invention. Those of ordinary skill in the art further understand that the exemplary hardware, software, processes, methods, and/or operating systems described herein are for illustrative purposes and, thus, are not intended to be limited to any particular named.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

Advantages of the Present Disclosure

The present disclosure provides an efficient and cost-effective solution of the above-mentioned problems.

The present disclosure provides a robust system and method for generating accurate anti-wave and/or anti-phase signals in earphones, such as but not limited to, earbuds for generating silence.

The present disclosure provides a reliable artificial intelligence based earbud system for generating anti-phase signals or anti-waves, in accordance with user instructions received in real-time, to cancel unwanted sound waves, thereby preventing unwanted sound from reaching ear canals, which may help to enhance sleep quality of the user.

The present disclosure provides a system and method that are capable to generate audible anti-phase signals and/or anti-waves for noise waves in earbuds using an artificial intelligence based mechanism which predicts the noise waves in a sound to create silence sounds.

The present disclosure provides a cost-effective system and methods for generating anti-phase signals in earbuds to make sure audio wave amplitudes, when reach ear canals, are zero or close to zero.

The present disclosure provides a simple artificial intelligence based system for generating silence in earbuds, which can be embedded on a system on a chip (SoC) and/or a field-programmable gate array (FPGA).

The present disclosure provides an artificial intelligence based earbud system that can be easily fitted in human ears and generate sound anti-phase signals to block any unwanted sound to travel through human ears canals.

The invention claimed is:

1. An earbud system for reducing noise, the system comprising:

an analog to digital converter configured to convert analog audio signals of a sound captured by one or more sound sensors of the earbud system into digital audio signals;

one or more processors and a memory coupled to the one or more processors, the memory comprising instruction which when executed by the one or more processors causes the one or more processors to:

filter one or more raw bits with a specific frequency band from the digital audio signals to obtain filtered digital audio signals;

extract human audible frequency bands from the filtered digital audio signals; and generate antiphase signals using an artificial intelligence based mechanism, for a first set of frequencies of the extracted human audible frequency bands to reduce noise; wherein the one or more processors generate phase signals, using the artificial intelligence (AI) based mechanism, for a second set of frequencies, wherein the second set of frequencies pertain to frequencies other than the first set of frequencies of the extracted human audible frequency bands, and wherein the generated audible phase signals are analog signals; wherein the one or more processors classify the extracted human audible frequency bands into ambient noise corresponding to the first set of frequencies and desired sound to be heard by the user corresponding to the second set of frequencies.

2. An earbud system for reducing noise, the system comprising: an analog to digital converter configured to convert analog audio signals of a sound captured by one or more sound sensors of the earbud system into digital audio signals;

one or more processors and a memory coupled to the one or more processors, the memory comprising instruction which when executed by the one or more processors causes the one or more processors to:

filter one or more raw bits with a specific frequency band from the digital audio signals to obtain filtered digital audio signals;

extract human audible frequency bands from the filtered digital audio signals; and generate antiphase signals using an artificial intelligence based mechanism, for a first set of frequencies of the extracted human audible frequency bands to reduce noise; wherein the one or more processors extract audio features from the extracted human audible frequency bands, wherein extraction of the audio features is based on any or combination of a set of second predefined instructions and the instruction received, in real-time, from the user associated with the earbud system.

3. The system as claimed in claim 2, wherein the extracted audio features comprise time frame, amplitude, frequency, and human emissions associated with the extracted human audible frequency bands.

4. A method for reducing noise in an earbud system, the method comprising:

converting, through an analog to digital converter, analog audio signals of a sound captured by one or more sound sensors of the earbud system into digital audio signals;

filtering, through one or more processors, one or more raw bits with a specific frequency band from the digital audio signals to obtain filtered digital audio signals;

extracting, through the one or more processors, human audible frequency bands from the filtered digital audio signals; and generating, through the one or more processors, anti-phase signals, using an artificial intelligence based mechanism, for a first set of frequencies of the extracted human audible frequency bands to reduce noise; wherein the method comprising a step of generating, through the one or more processors, phase signals, using the artificial intelligence based mechanism, for a second set of frequencies, wherein the second set of frequencies pertain to frequencies other than the first set of frequencies of the extracted human audible frequency bands, and wherein the generated audible phase signals are analog signals; wherein, based on an instruction received, in real- time, from a user, the one or more processors predict, using the artificial intelligence (AI) based mechanism, the first set of frequencies of the extracted human audible frequency bands for which anti-phase signals to be generated and the second set of frequencies of the extracted human audible frequency bands for which the audible phase signals to be generated; wherein the one or more processors classify the extracted human audible frequency bands into ambient noise corresponding to the first set of frequencies and desired sound to be heard by the user corresponding to the second set of frequencies.

5. A method for reducing noise in an earbud system, the method comprising:

converting, through an analog to digital converter, analog audio signals of a sound captured by one or more sound sensors of the earbud system into digital audio signals;

filtering, through one or more processors, one or more raw bits with a specific frequency band from the digital audio signals to obtain filtered digital audio signals;

extracting, through the one or more processors, human audible frequency bands from the filtered digital audio signals; and generating, through the one or more processors, anti-phase signals, using an artificial intelligence based mechanism, for a first set of frequencies of the extracted human audible frequency bands to reduce noise;

wherein the method comprising a step of extracting, through the one or more processors, audio features from the extracted human audible frequency bands, wherein extraction of the audio features is based on any or combination of a set of second predefined instructions and the instruction received, in real-time, from a user associated with the earbud system.

6. The method as claimed in claim 5, wherein the extracted audio features comprise time frame, amplitude, frequency, and human emissions associated with the extracted human audible frequency bands.

7. The system as claimed in claim 3, wherein neutralization of human hearing frequency range is in a standalone mode and automatically start the power-on cycle without requiring any initialization of communication between a pair of devices to be active.

8. The method as claimed in claim 6, wherein integration or usage of the Artificial Intelligence based mechanism converts the filtered sound wave to output states with defined priorities interruptions.

9. The method as claimed in claim 8, wherein the user has options to define priority states and interruption order of all events in any mode of operations.

* * * * *